US007570146B2

(12) United States Patent
Mills et al.

(10) Patent No.: US 7,570,146 B2
(45) Date of Patent: Aug. 4, 2009

(54) CIRCUIT BREAKER INCLUDING AMBIENT COMPENSATION BIMETAL HOLDING AND RELEASING ARC FAULT INDICATOR

(75) Inventors: Patrick W. Mills, Bradenton, FL (US); Richard G. Benshoff, Sarasota, FL (US)

(73) Assignee: Eaton Corporation, Cleveland, OH (US)

( * ) Notice: Subject to any disclaimer, the term of this patent is extended or adjusted under 35 U.S.C. 154(b) by 204 days.

(21) Appl. No.: 11/782,848

(22) Filed: Jul. 25, 2007

(65) Prior Publication Data

US 2009/0027154 A1 Jan. 29, 2009

(51) Int. Cl.
*H01H 83/06* (2006.01)
*H01H 73/12* (2006.01)
*H01H 71/22* (2006.01)

(52) U.S. Cl. ..... 337/101; 337/79; 337/66; 337/78

(58) Field of Classification Search ..... 337/79, 337/66, 78, 99, 101
See application file for complete search history.

(56) References Cited

U.S. PATENT DOCUMENTS

| | | | | | |
|---|---|---|---|---|---|
| 3,234,348 | A | * | 2/1966 | Desio | 337/95 |
| 3,792,403 | A | | 2/1974 | Bullock | |
| 4,517,543 | A | * | 5/1985 | Brubaker | 337/140 |
| 4,536,736 | A | * | 8/1985 | Aschenbach | 337/317 |
| 4,698,612 | A | * | 10/1987 | Koehler | 337/320 |
| 5,191,310 | A | * | 3/1993 | Obermann et al. | 337/105 |
| 5,224,006 | A | | 6/1993 | MacKenzie et al. | |
| 5,459,446 | A | | 10/1995 | Vidal et al. | |
| 5,546,266 | A | | 8/1996 | Mackenzie et al. | |
| 5,691,869 | A | | 11/1997 | Engel et al. | |
| 5,831,500 | A | | 11/1998 | Turner et al. | |
| 5,847,913 | A | | 12/1998 | Turner et al. | |
| 6,075,215 | A | | 6/2000 | Bollinger, Jr. et al. | |
| 6,084,756 | A | | 7/2000 | Doring et al. | |
| 6,225,883 | B1 | | 5/2001 | Wellner et al. | |
| 6,307,453 | B1 | | 10/2001 | Wellner et al. | |
| 6,365,855 | B1 | | 4/2002 | Sutter et al. | |
| 6,490,150 | B1 | | 12/2002 | Theisen et al. | |
| 6,522,228 | B2 | | 2/2003 | Wellner et al. | |
| 6,542,056 | B2 | | 4/2003 | Nerstrom et al. | |
| 6,639,492 | B1 | | 10/2003 | Hall et al. | |
| 6,650,515 | B2 | | 11/2003 | Schmalz | |
| 6,710,688 | B2 | | 3/2004 | Wellner et al. | |

(Continued)

FOREIGN PATENT DOCUMENTS

EP 1126492 A2 * 8/2001

*Primary Examiner*—Anatoly Vortman
(74) *Attorney, Agent, or Firm*—Bradley J. Diedrich

(57) ABSTRACT

An aircraft circuit breaker includes a housing having an opening, separable contacts, an operating mechanism structured to open and close the contacts, and a trip mechanism structured to cooperate with the operating mechanism to trip open the operating mechanism. The trip mechanism includes a first bimetal to trip open the operating mechanism responsive to a thermal fault, a second ambient compensation bimetal to compensate the first bimetal, and an arc fault trip circuit to trip open the operating mechanism responsive to an arc fault. An indicator includes an indicator portion and a leg disposed from the indicator portion. A spring biases the indicator portion. The second bimetal holds the leg of the indicator, thereby holding the indicator against the spring bias. The second bimetal releases the leg of the indicator responsive to the arc fault trip circuit and the arc fault, thereby releasing the indicator to the spring bias.

23 Claims, 9 Drawing Sheets

U.S. PATENT DOCUMENTS

| | | | | |
|---|---|---|---|---|
| 6,744,260 | B2 | 6/2004 | Schmalz et al. | |
| 6,813,131 | B2 | 11/2004 | Schmalz | |
| 6,864,765 | B2 | 3/2005 | Wellner et al. | |
| 6,867,670 | B2 * | 3/2005 | McCormick et al. | 335/6 |
| 7,062,388 | B2 * | 6/2006 | Rivers et al. | 702/57 |
| 7,064,636 | B1 * | 6/2006 | Walz et al. | 335/18 |
| 7,170,376 | B2 | 1/2007 | Mills et al. | |
| 2002/0080003 | A1 * | 6/2002 | Pellon et al. | 337/55 |
| 2004/0257183 | A1 * | 12/2004 | Fello et al. | 335/172 |
| 2006/0125583 | A1 * | 6/2006 | Mills et al. | 335/172 |
| 2006/0254893 | A1 * | 11/2006 | Mills et al. | 200/313 |

* cited by examiner

CIRCUIT BREAKER INCLUDING AMBIENT COMPENSATION BIMETAL HOLDING AND RELEASING ARC FAULT INDICATOR

BACKGROUND OF THE INVENTION

1. Field of the Invention

This invention relates generally to electrical switching apparatus and, more particularly, to circuit breakers, such as, for example, arc fault circuit breakers.

2. Background Information

Circuit breakers are used to protect electrical circuitry from damage due to an overcurrent condition, such as an overload condition or a relatively high level short circuit or fault condition. In small circuit breakers, commonly referred to as miniature circuit breakers, used for residential and light commercial applications, such protection is typically provided by a thermal-magnetic trip device. This trip device includes a bimetal, which heats and bends in response to a persistent overcurrent condition. The bimetal, in turn, unlatches a spring powered operating mechanism, which opens the separable contacts of the circuit breaker to interrupt current flow in the protected power system.

Subminiature circuit breakers are used, for example, in aircraft electrical systems where they not only provide overcurrent protection but also serve as switches for turning equipment on and off. As such, they are subjected to heavy use and, therefore, must be capable of performing reliably over many operating cycles. They also must be small to accommodate the high-density layout of circuit breaker panels, which make circuit breakers for numerous circuits accessible to a user. Aircraft electrical systems usually consist of hundreds of circuit breakers, each of which is used for a circuit protection function as well as a circuit disconnection function through a push-pull handle. The push-pull handle is moved from in-to-out in order to open the load circuit. This action may be either manual or, else, automatic in the event of an overload or fault condition. If the push-pull handle is moved from out-to-in, then the load circuit is re-energized. If the load circuit had been automatically de-energized, then the out-to-in operation of the push-pull handle corresponds to a circuit breaker reset action.

Typically, subminiature circuit breakers have only provided protection against persistent overcurrents implemented by a latch triggered by a bimetal responsive to $I^2R$ heating resulting from the overcurrent. There is a growing interest in providing additional protection, and most importantly arc fault protection. Arc faults are typically high impedance faults and can be intermittent. Nevertheless, such arc faults can result in a fire.

During sporadic arc fault conditions, the overload capability of the circuit breaker will not function since the root-mean-squared (RMS) value of the fault current is too small to activate the automatic trip circuit. The addition of electronic arc fault sensing to a circuit breaker can add one of the elements required for sputtering arc fault protection—ideally, the output of an electronic arc fault sensing circuit directly trips and, thus, opens the circuit breaker. It is still desirable, however, to provide separate indications in order to distinguish an arc fault trip from an overcurrent-induced trip.

Finally, there is an interest in providing an instantaneous trip in response to very high overcurrents such as would be drawn by a short circuit.

The challenge is to provide alternative protection and separate indications in a very small package, which will operate reliably with heavy use over a prolonged period. A device which meets all the above criteria and can be automatically assembled is desirable.

In aircraft applications, two practical considerations make automatic operation difficult to achieve and, possibly, undesirable. First, the design of a conventional aircraft circuit breaker makes it difficult to add an externally initiated tripping circuit thereto. Second, certain circuits on an aircraft are so critical that manual intervention by a crewmember may be desirable before a circuit is de-energized.

U.S. Pat. No. 6,542,056 discloses a movable and illuminable arc fault indicator including a first leg having a notch near the lower end thereof. The notch is engaged by a first arm of a spring. The spring has a central portion, which is held by a pin on a mechanism plate, and a second arm, which is held between side-by-side pins on the plate. The indicator also includes a second leg or light pipe member and an illuminable ring portion, which is connected to the legs. The indicator is normally recessed within the bezel of a circuit breaker housing. Under normal operating conditions, an arc fault circuit energizes a light emitting diode (LED). The free end of the light pipe is normally proximate the LED and normally receives light therefrom when the circuit is energized. Hence, the LED normally illuminates the light pipe and, thus, the illuminable ring portion. The illuminable ring portion is visible, in order to indicate, when lit, proper energization of the circuit. An indicator latch of a trip motor normally holds the first arm of the spring. When the trip motor is energized, the first arm disengages from an opening of the indicator latch and drives the first leg of the indicator upward, thereby driving the indicator ring upward to an arc fault trip position in which the light pipe is separated from the LED. As a result of the trip, power is removed to the circuit and the illuminable ring portion is no longer lit.

There is room for improvement in circuit breakers.

SUMMARY OF THE INVENTION

These needs and others are met by embodiments of the invention, which provide a trip mechanism comprising a first portion structured to trip open an operating mechanism responsive to a thermal fault, a second portion structured to compensate the first portion, and a third portion structured to trip open the operating mechanism responsive to an arc fault. An indicator comprises an indicator portion and a leg disposed from the indicator portion. A bias mechanism is structured to bias the indicator portion. The second portion of the trip mechanism is normally structured to hold the leg of the indicator, thereby holding the indicator against the bias of the bias mechanism, and is also structured to release the leg of the indicator responsive the third portion of the trip mechanism and the arc fault, thereby releasing the indicator to the bias of the bias mechanism.

In accordance with one aspect of the invention, a circuit breaker comprises: a housing including an opening; separable contacts disposed in the housing; an operating mechanism structured to open and close the separable contacts; a trip mechanism structured to cooperate with the operating mechanism to trip open the operating mechanism, the trip mechanism comprising a first portion structured to trip open the operating mechanism responsive to a thermal fault, a second portion structured to compensate the first portion, and a third portion structured to trip open the operating mechanism responsive to an arc fault; an indicator comprising an indicator portion and a leg disposed from the indicator portion; and a bias mechanism structured to bias the indicator, wherein the second portion of the trip mechanism is normally structured to hold the leg of the indicator, thereby holding the indicator against the bias of the bias mechanism, and wherein the second portion of the trip mechanism is also structured to release the leg of the indicator responsive the third portion of the trip mechanism and the arc fault, thereby releasing the indicator to the bias of the bias mechanism.

The first portion of the trip mechanism may comprise a bimetal structured to trip open the operating mechanism responsive to the thermal fault; and the third portion of the operating mechanism may comprise a solenoid structured to trip open the operating mechanism responsive to the arc fault.

The leg of the indicator may be a first leg; the indicator may comprise a second leg disposed from the indicator portion; the housing may comprise a bezel including the opening and an interior surface; the first leg of the indicator may include a hook which is normally held by the second portion of the trip mechanism; the bias mechanism may bias the indicator portion external to the housing; and the second leg of the indicator may include a foot, the foot being structured to engage the interior surface of the bezel after the second portion of the trip mechanism releases the first leg of the indicator responsive to the arc fault, thereby limiting travel of the indicator portion external to the housing.

The first portion of the trip mechanism may comprise a first bimetal structured to trip open the operating mechanism responsive to the thermal fault, the second portion of the trip mechanism may comprise a second ambient compensation bimetal structured to compensate the first bimetal for changes in ambient temperature, and both of the first bimetal and the second ambient compensation bimetal may be elongated and comprise a first end, a second end opposite the first end and an intermediate portion between the first and second ends, the intermediate portion of the first bimetal may be structured to move in a first direction responsive to an increase in current flowing through the separable contacts, the intermediate portion of the first bimetal may be structured to move in an opposite second direction responsive to a decrease in current flowing through the separable contacts, the intermediate portion of the second ambient compensation bimetal may be structured to move in the first direction responsive to an increase in the ambient temperature, the intermediate portion of the second ambient compensation bimetal may be structured to move in the opposite second direction responsive to a decrease in the ambient temperature.

The third portion of the trip mechanism may comprise an arc fault trip circuit and a solenoid including a coil and a plunger, the second ambient compensation bimetal may comprise a spring normally holding the first end of the second ambient compensation bimetal fixed with respect to the housing, the first end of the second ambient compensation bimetal may carry a latch member, the latch member may normally latch the leg of the indicator; the arc fault trip circuit may be structured to detect the arc fault and energize the coil, and the plunger, responsive to the coil being energized, may be structured to move the intermediate portion of the second ambient compensation bimetal in the opposite second direction in order to trip open the separable contacts, and also move the first end of the second ambient compensation bimetal, in order that the latch member releases the leg of the indicator responsive to the arc fault.

The operating mechanism may comprise a stem passing through the opening of the housing and an operating member disposed on the stem external to the housing; the indicator portion may be a conduit surrounding the operating stem, the first portion of the trip mechanism may comprise a first bimetal structured to trip open the operating mechanism responsive to the thermal fault, the second portion of the trip mechanism may comprise a second ambient compensation bimetal structured to compensate the first bimetal for changes in ambient temperature, the second ambient compensation bimetal may comprise a spring and an end holding a latch member, the spring may normally hold the end of the second ambient compensation bimetal fixed with respect to the housing, the latch member may normally latch the leg of the indicator, the second ambient compensation bimetal and the third portion of the trip mechanism may be responsive to the arc fault independent from the first bimetal.

The first portion of the trip mechanism may comprise a first bimetal structured to trip open the operating mechanism responsive to the thermal fault, the second portion of the trip mechanism may comprise a second ambient compensation bimetal structured to compensate the first bimetal for changes in ambient temperature, the second ambient compensation bimetal may comprise a number of springs and an end holding a latch member, the number of springs may normally hold the end of the second ambient compensation bimetal fixed with respect to the housing, the latch member may normally latch the leg of the indicator, the second ambient compensation bimetal and the third portion of the trip mechanism may be responsive to the arc fault independent from the first bimetal.

The latch member may normally latch the leg of the indicator with a force, and the second ambient compensation bimetal further may comprise a number of adjustment members, which cooperate with the number of springs to adjust the force.

As another aspect of the invention, an aircraft circuit breaker comprises: a housing including an opening; separable contacts disposed in the housing; an operating mechanism structured to open and close the separable contacts; a trip mechanism structured to cooperate with the operating mechanism to trip open the operating mechanism, the trip mechanism comprises a first bimetal structured to trip open the operating mechanism responsive to a thermal fault, a second ambient compensation bimetal structured to compensate the first bimetal, and an arc fault trip circuit structured to trip open the operating mechanism responsive to an arc fault; an indicator comprises an indicator portion and a leg disposed from the indicator portion; and a bias mechanism structured to bias the indicator, the second ambient compensation bimetal is normally structured to hold the leg of the indicator, thereby holding the indicator against the bias of the bias mechanism, and the second ambient compensation bimetal is also structured to release the leg of the indicator responsive to the arc fault trip circuit and the arc fault, thereby releasing the indicator to the bias of the bias mechanism.

The arc fault trip circuit may comprise an electromechanical mechanism, the first bimetal may move responsive to the thermal fault to trip open the operating mechanism independent from the electromechanical mechanism, and the electromechanical mechanism may be structured to move the second ambient compensation bimetal responsive to the arc fault to trip open the operating mechanism.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "thermal fault" shall mean a thermal overload current condition or other overcurrent condition.

The invention is described in association with a subminiature aircraft or aerospace arc fault circuit breaker, although the invention is applicable to a wide range of circuit breakers for power circuits.

Figure 1:
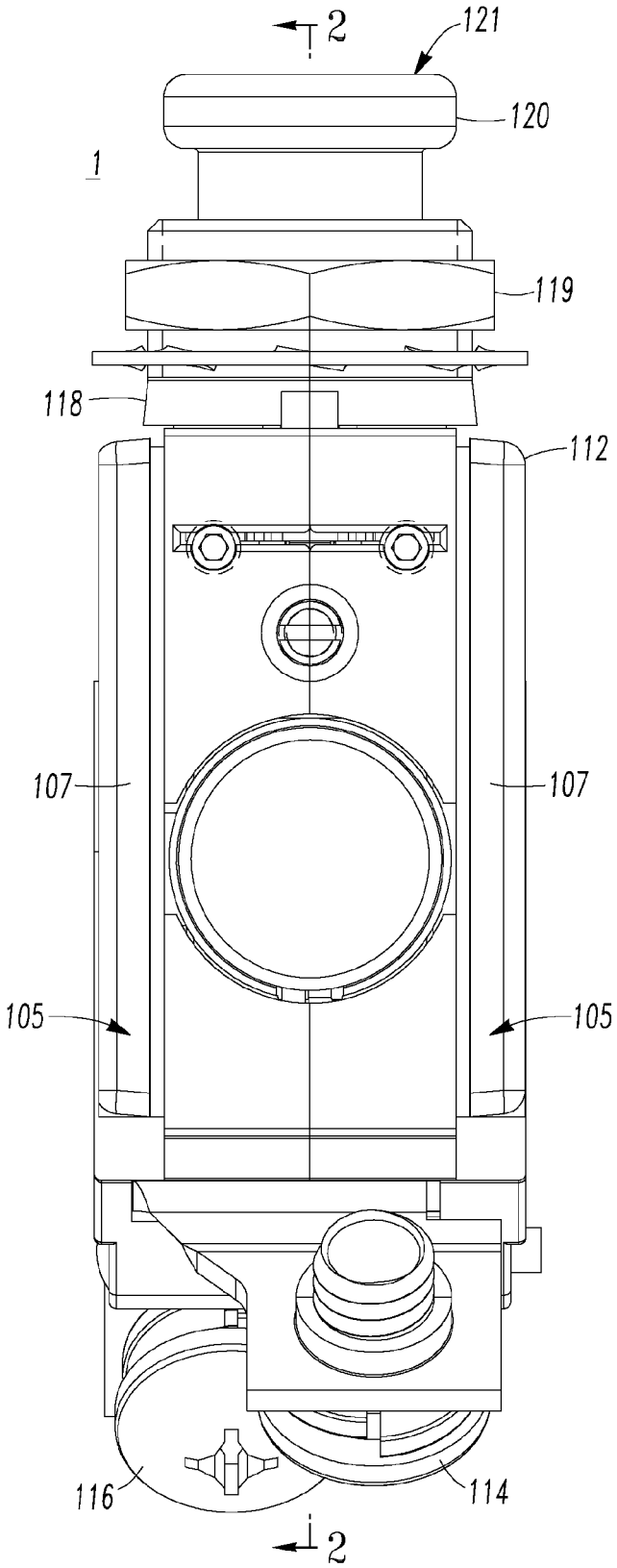
FIG. 1 is a side elevation view of a circuit breaker in accordance with embodiments of the invention.
Figure 2:
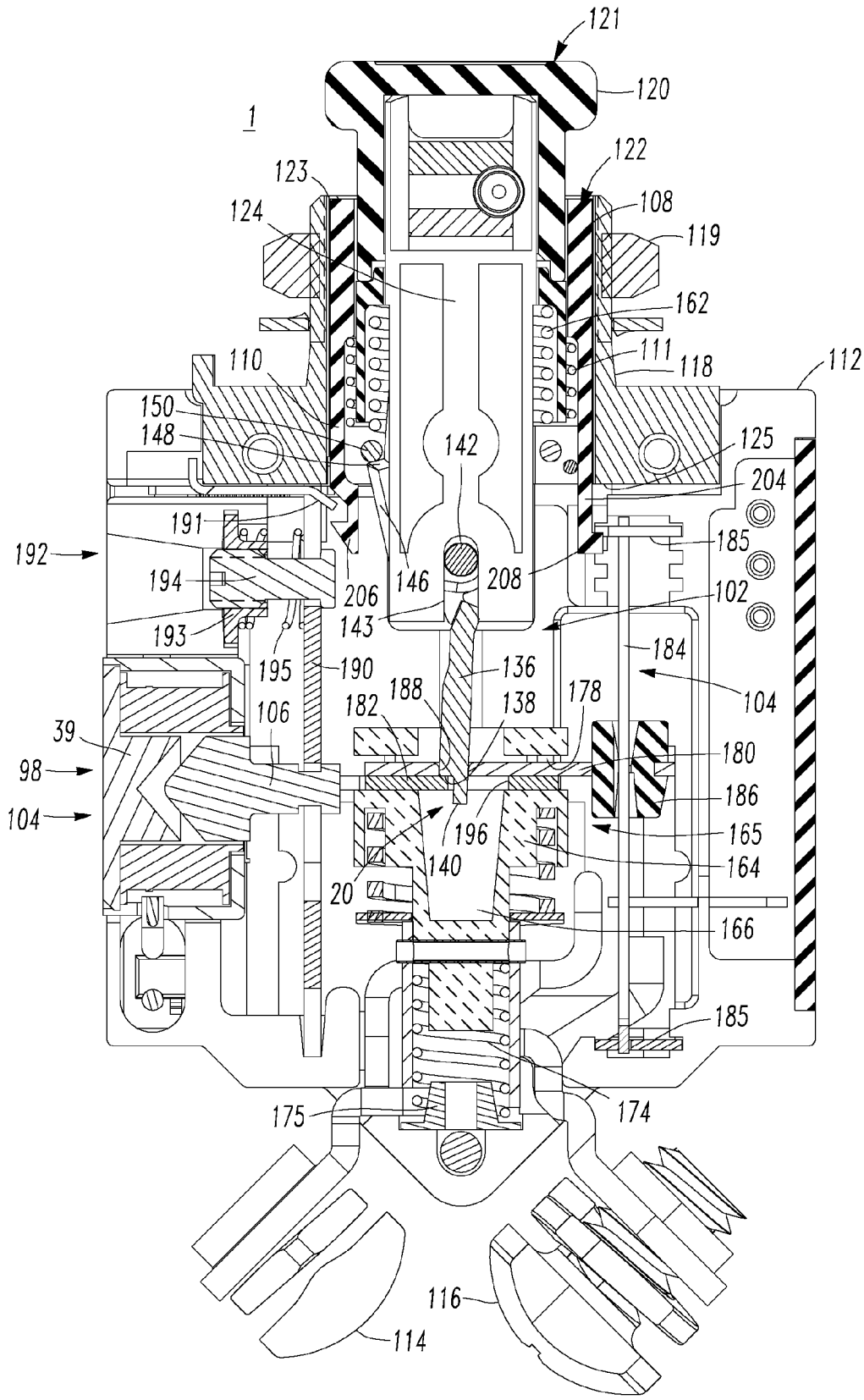
FIG. 2 is a cross-sectional view along lines 2-2 of FIG. 1.

Referring to FIGS. 1 and 2, a circuit breaker (e.g., without limitation, a subminiature aircraft or aerospace arc fault circuit breaker 1) comprises separable contacts 100 (FIG. 10), an operating mechanism 102 (FIGS. 2 and 10) structured to open and close the separable contacts 100, and a trip mechanism 104 (FIG. 2) structured to cooperate with the operating mechanism 102 to trip open the operating mechanism 102 and the separable contacts 100.

Continuing to refer to FIG. 2, the trip mechanism 104 includes a first portion, such as an elongated bimetal 184, structured to trip open the operating mechanism 102 responsive to a thermal fault, a second portion, such as an elongated ambient temperature compensation bimetal 190, structured to compensate the bimetal 184 for changes in ambient temperature, and a third portion, such as an electromagnetic device, such as a solenoid (e.g., without limitation, miniature coil assembly 98), including a trip coil 39 and a plunger 106, structured to trip open the operating mechanism 102 when the trip coil 39 is energized responsive to detection of an arc fault. The ambient temperature compensation bimetal 190 moves responsive to ambient temperature and independently from the bimetal 184. The bimetal 184 moves responsive to its temperature changes arising from changes in current flowing through the separable contacts 100 (e.g., without limitation, a thermal fault) and through the bimetal 184. This movement is independent from the solenoid plunger 106. The plunger 106 moves the ambient temperature compensation bimetal 190 responsive to the arc fault and independent from the bimetal 184.

The trip mechanism 104 further includes an arc fault trip circuit 105 structured to trip open the operating mechanism 102 responsive to detection of an arc fault. The arc fault trip circuit 105 includes the miniature coil assembly 98 and an arc fault detection circuit 107 as is disclosed in U.S. Pat. No. 7,170,376, which is incorporated by reference herein. The bimetal 184 moves responsive to a thermal fault to trip open the operating mechanism 102 independent from the miniature coil assembly 98, which is structured to move the ambient temperature compensation bimetal 190 responsive to detection of an arc fault to trip open the operating mechanism 102. The arc fault detection circuit 107 energizes the trip coil 39 responsive to the arc fault. In turn, the plunger 106 and the ambient temperature compensation bimetal 190 are moved responsive to the coil 39 being energized.

Normally, both ends (upper and lower with respect to FIG. 2) of the bimetal 184 and the ambient temperature compensation bimetal 190 are fixedly mounted within housing 112. The intermediate (e.g., without limitation, central) portion of the bimetal 184 is structured to move right (with respect to FIG. 2) responsive to an increase in current flowing through the separable contacts 100 (and, thus, responsive to an increase in temperature of the bimetal 184) and is structured to move left (with respect to FIG. 2) responsive to a decrease in current flowing through the separable contacts 100 (and, thus, responsive to a decrease in temperature of the bimetal 184). The intermediate (e.g., without limitation, central) portion of the ambient temperature compensation bimetal 190 is structured to move right (with respect to FIG. 2) responsive to an increase in the ambient temperature and is structured to move left (with respect to FIG. 2) responsive to a decrease in the ambient temperature.

Figure 5:
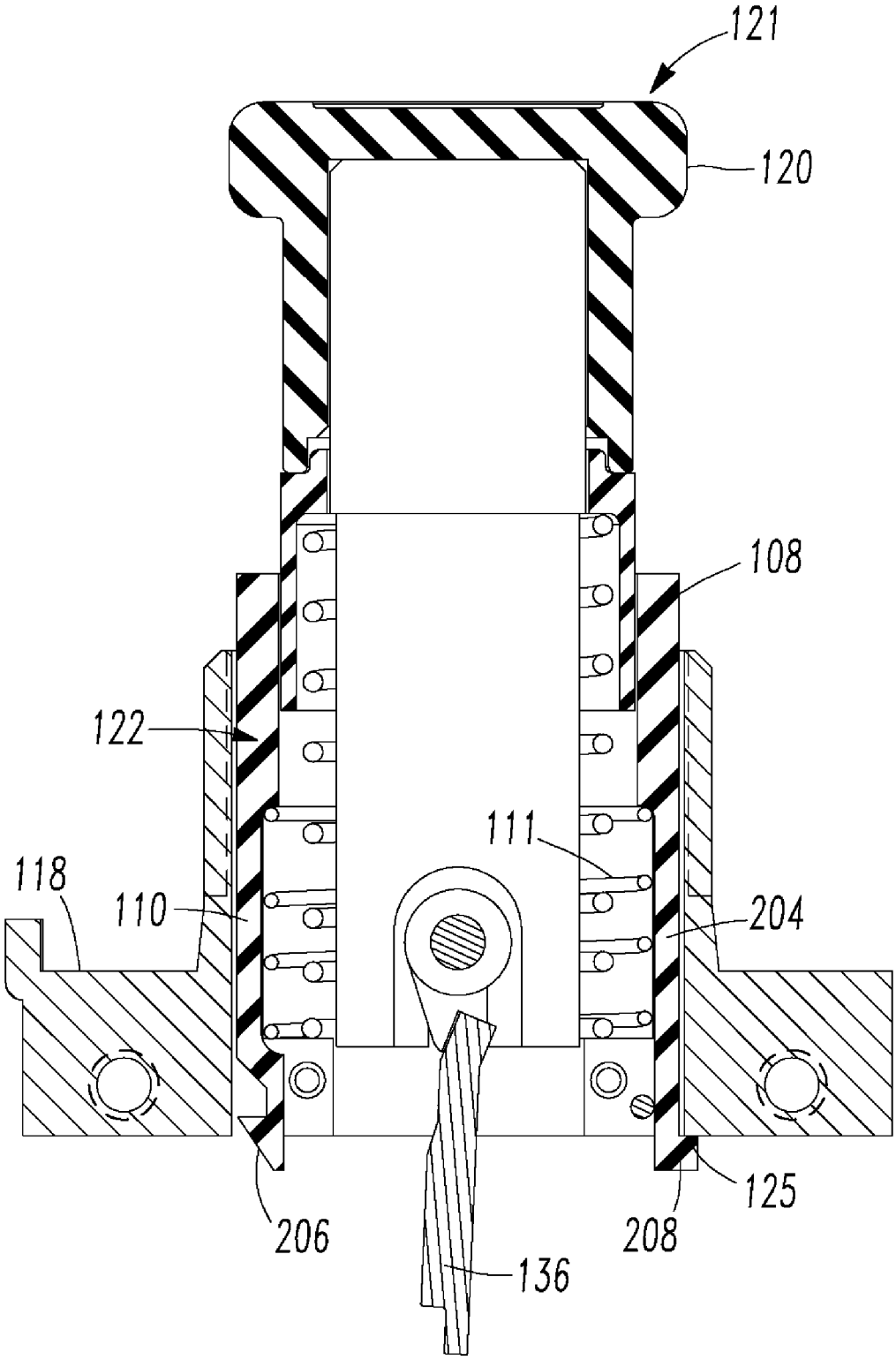
FIG. 5 is a simplified view of the operating handle and indicator of FIG. 2 in the open arc fault position.

A trip indicator 122 includes an indicator portion 108 and a leg 110 disposed therefrom. A bias mechanism (e.g., without limitation, spring 111) is structured to bias the indicator portion 108 external to the housing 112 as shown in FIG. 5. As will be discussed, the ambient temperature compensation bimetal 190 includes a latch member 191, which is normally structured to hold the trip indicator leg 110, thereby holding the trip indicator 122 against the bias of the spring 111. This latch member 191 is structured to release the trip indicator leg 110 responsive the plunger 106, which moves left (with respect to FIG. 2) in response to detection of an arc fault, thereby releasing the trip indicator 122 to move upward (with respect to FIG. 2) in response to the spring bias. An arc fault trip of the operating mechanism 102 and an arc fault trip indication through the trip indicator 122 are both initiated through the miniature coil assembly 98 and the ambient temperature compensation bimetal 190. Hence, the indicator portion 108 is disposable through the housing opening 123 and deploys in response to an electronic signal from the arc fault detection circuit 107, which energizes the trip coil 39.

Figure 9:
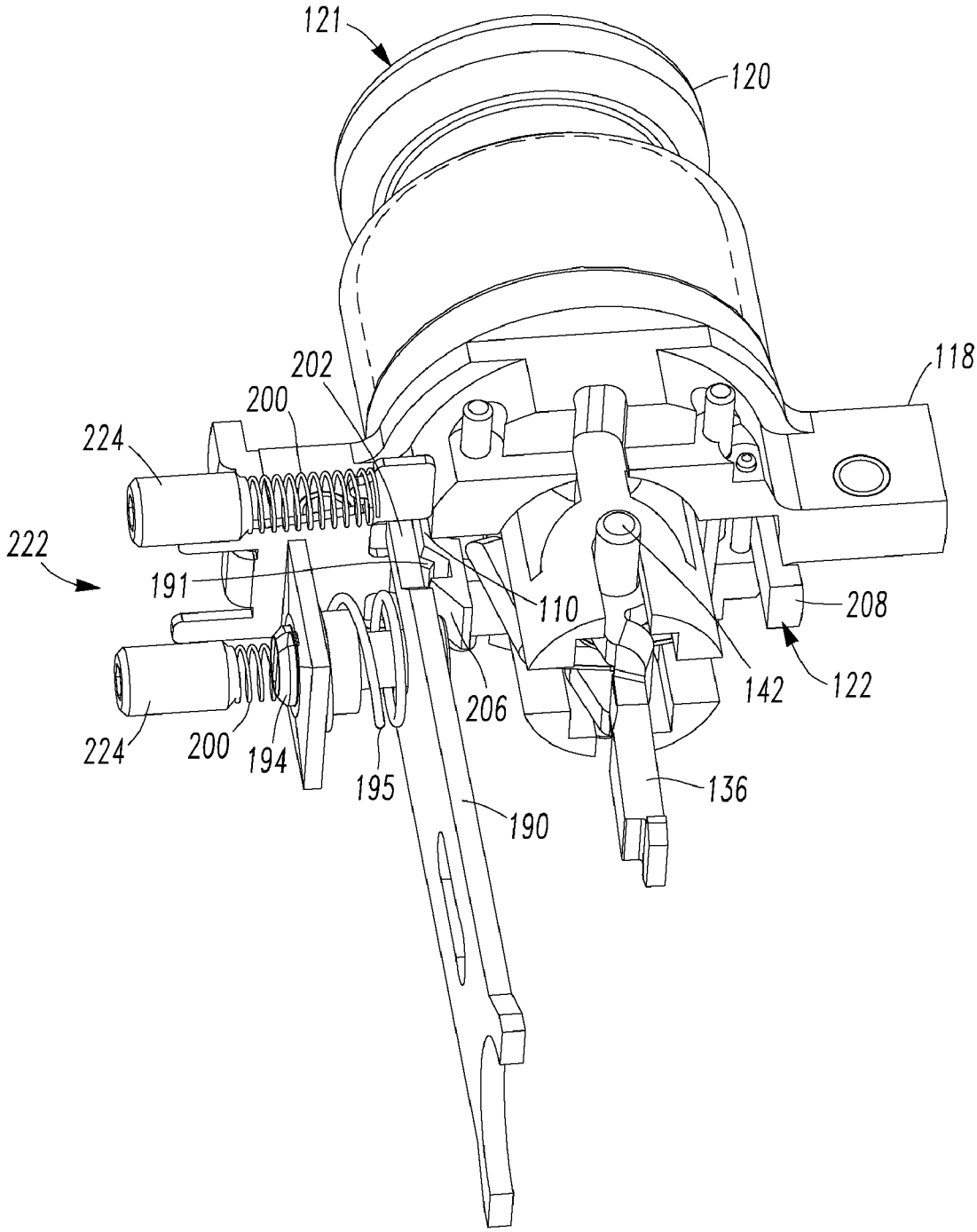
FIG. 9 is an isometric view of the operating handle, indicator and latch adjustment mechanism of FIG. 2.

As best shown in FIG. 9, the ambient temperature compensation bimetal 190 includes a number of springs 200 and an end 202 holding the latch member 191. The springs 200 normally hold the end 202 of the ambient temperature compensation bimetal 190 fixed with respect to the housing 112 (FIG. 2) and the latch member 191 normally latches the indicator leg 110.

The separable contacts 100 (FIG. 10) are disposed in the housing 112 (e.g., enclosure) having a pair of terminals 114 and 116 thereon which extend exteriorly of the enclosure 112 for electrical connection to an electrical source and load, respectively. The enclosure 112 includes a bezel (e.g., without limitation, a threaded, conductive ferrule 118) including the opening 123 and an interior surface 125. The ferrule 118 extends exteriorly of the enclosure 112 for the guidance of an operating handle (e.g., without limitation, manual operator 120) of an operating stem (e.g., without limitation, plunger assembly 121). The ferrule 118, in conjunction with a nut 119, provides a mounting and electrically conductive connection mechanism for the circuit breaker 1 on a panelboard (not shown).

The manual operator 120 and trip indicator 122 are capable of sliding axial movement with respect to the ferrule 118 through the opening 123 of the ferrule 118. The manual operator 120 is provided with a central portion 124.

A clevis or thermal latch element 136 is provided with a latch surface 138 and a depending portion 140. The clevis 136 is pivotally supported by a pin 142, which is movable relative to the manual operator 120 in a slot 143. The end portions of the pin 142 are retained within grooves (not shown) in the central housing 112, which grooves guide axial movement thereof.

A mechanical latch element 146 is provided with a latching surface 148, which engages a cooperating latching surface 150 on the ferrule 118. The latch element 146 is structured to engage the latching surface 150 until a latch 20 is actuated.

A spring 162 is provided to resiliently bias the manual operator 120, clevis 136 and latch element 146 upwardly with respect to the ferrule 118.

A movable contact carrier or plunger 164 of a contact plunger assembly 165 has a central opening 166 therein for acceptance of the clevis 136. The contact carrier 164 carries a contact bridge 168 (FIG. 10) having a pair of movable contacts 170 (only one contact 170 is shown) positioned thereon. The movable contacts 170 are engageable with fixed contacts 172 to complete a circuit from terminal 114 to terminal 116 through the current responsive bimetal 184 of the circuit breaker 1. A helical coil plunger return spring 174 (FIG. 2) abuts against a spring retainer portion 175 of the housing 112 at one end and the movable contact carrier 164 at its other end, in order to normally bias the contact carrier 164 upwardly relative to the housing 112.

The contact carrier 164 has a laterally extending slot 178 therein for the acceptance of a thermal slide portion, such as overload slide 180, and an ambient slide portion, such as ambient temperature slide 182. The overload slide 180 is movable internally of the contact carrier 164 under the influence of the elongated current responsive bimetal 184, which is retained within the housing 112 by end supports 185 at each end thereof. The overload slide 180 is structured to capture the clevis 136 absent a thermal fault, when the overload slide 180 moves with the intermediate portion of the bimetal 184 to the right (with respect to FIG. 2) to release the clevis 136. As will be discussed, in addition to providing ambient temperature compensation to the bimetal 184, the ambient temperature slide 182 is also structured to capture the clevis 136 absent a thermal fault or absent an arc fault, when the ambient temperature slide 182 moves with the plunger 106 and the intermediate portion of the ambient temperature compensation bimetal 190 to the left (with respect to FIG. 2) to release the clevis 136. Hence, the ambient temperature compensation bimetal 190 and the miniature coil assembly plunger 106 are responsive to arc faults independent from the bimetal 184.

Figure 10:
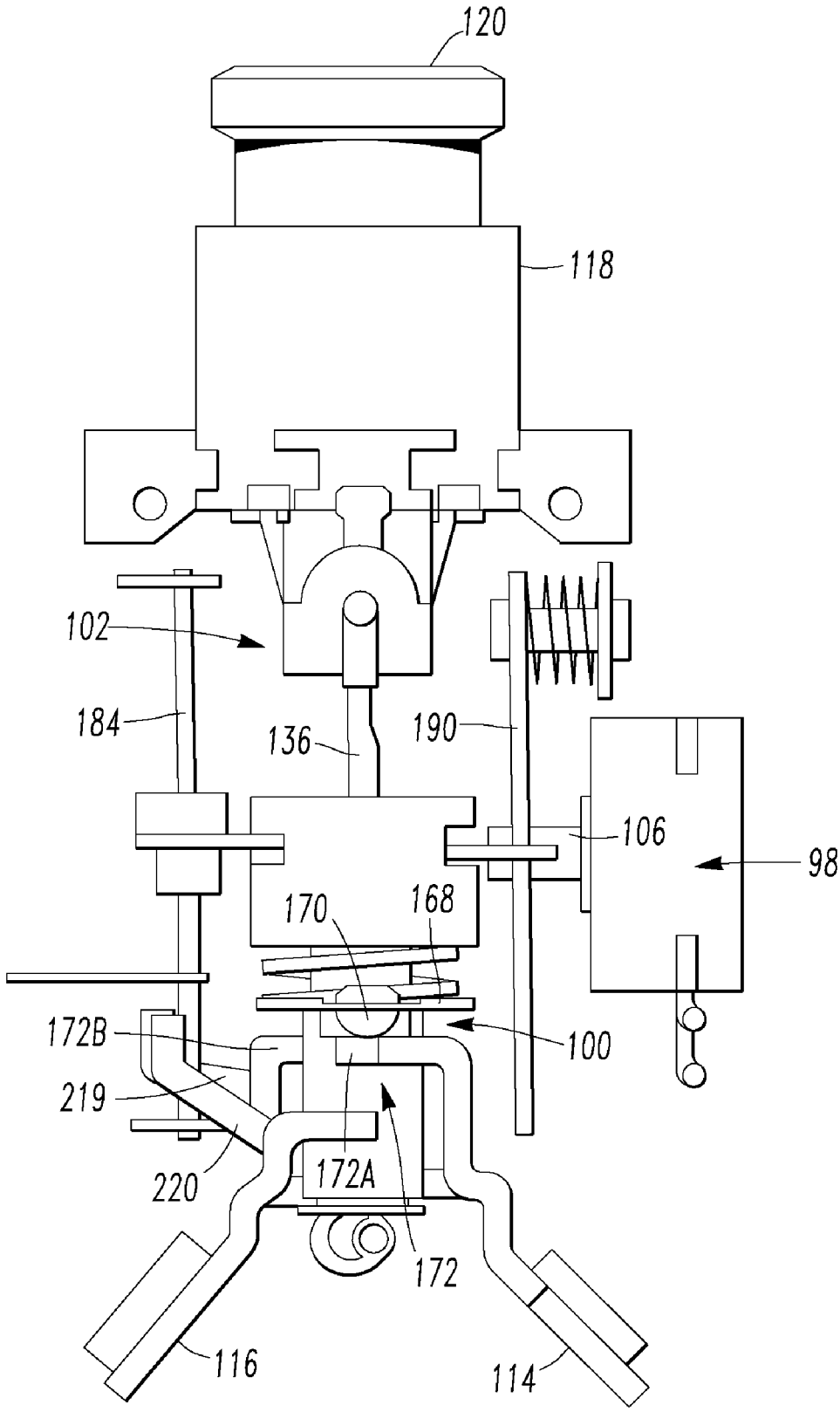
FIG. 10 is a vertical elevation view of a portion of the operating mechanism of FIG. 2.

A clevis guide assembly (e.g., without limitation, made of ceramic) 186 couples the overload slide 180 to and insulates it from the bimetal 184. The overload slide 180 is provided with a slot 188, which accepts and closely cooperates with the clevis 136 to effect actuation of the latch 20 and release of the clevis 136 in response to lateral movement (e.g., right with respect to FIG. 2) of the slide 180. This, in turn, releases the latch element 146 in order to open the contacts 170, 172 (FIG. 10).

The ambient temperature slide 182 underlies the overload slide 180 and is movable internally of the contact carrier 164 under the influence of the elongated ambient temperature compensation bimetal 190, which is part of an ambient compensator assembly 192 including an adjustable screw guide 193, a calibrate screw 194 and a compensator spring 195.

The ambient temperature compensation bimetal 190 is interlocked to the ambient temperature slide 182, whereby lateral movement of such slide 182 is controlled, in part, by such bimetal 190. The ambient temperature slide 182 is provided with a slot 196, which, when the circuit breaker 1 is in the contacts closed position, as shown, accepts the hooked end depending portion 140 of the clevis 136. In the contacts closed position, the latch surface 138 of the clevis 136 engages the upper surface of the ambient temperature slide 182 adjacent the periphery of the slot 196 with a pressure determined by the upward resilient bias provided by spring 174.

Figure 3:
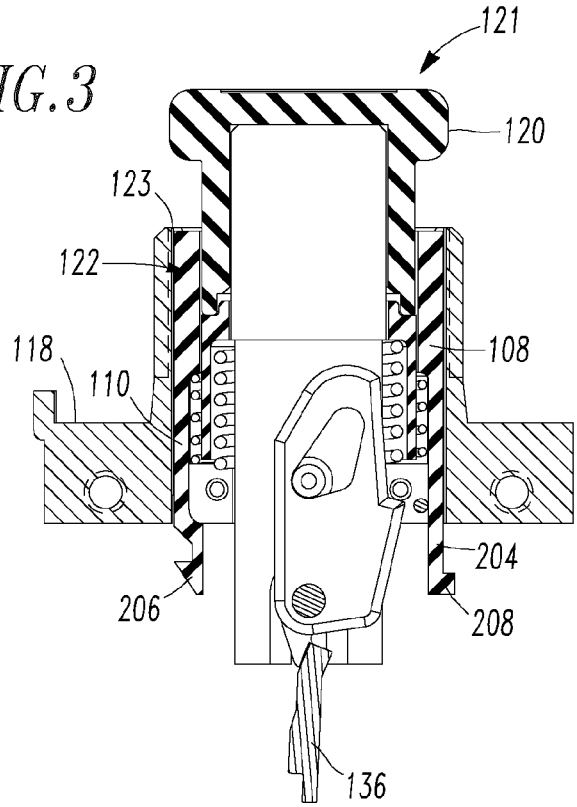
FIG. 3 is a simplified view of the operating handle and indicator of FIG. 2 in the closed position.
Figure 4:
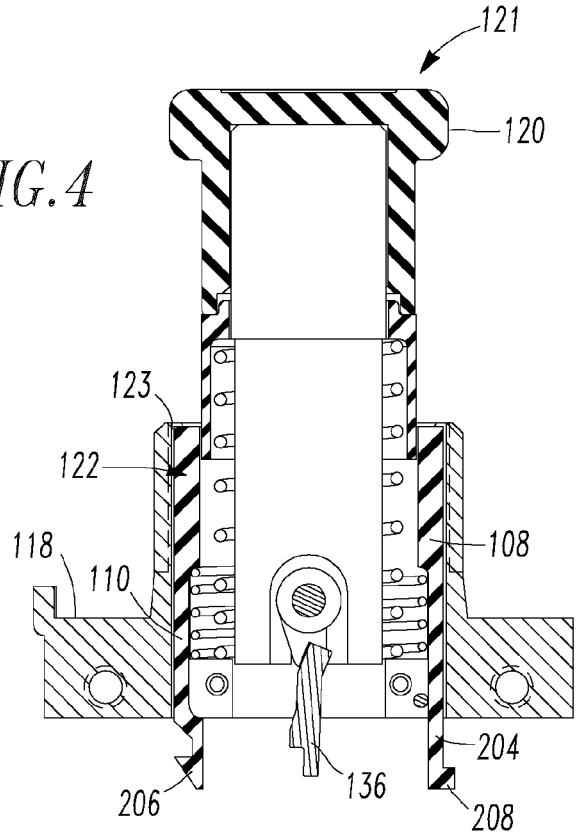
FIG. 4 is a simplified view of the operating handle and indicator of FIG. 2 in the open thermal position.

Referring to FIG. 3, the manual operator 120 and the trip indicator 122 are shown in the closed position of the circuit breaker 1 of FIG. 2. The operating mechanism 102 includes the plunger assembly 121, which passes through the opening 123 of the housing 112, and the manual operator 120 disposed on the plunger assembly 121 external to the housing 112. The indicator portion 108 is a conduit (e.g., without limitation, a halo) surrounding the plunger assembly 121. As was discussed above in connection with FIG. 2, the bimetal 184 and overload slide 180 release the clevis 136 and, thus, the plunger assembly 121 to extend the manual operator 120 further external to the housing 112 as shown in FIG. 4 responsive to a thermal fault. The ambient temperature compensation bimetal 190 and the latch member 191 (FIG. 2) thereof hold the indicator leg 110 in the position shown in FIGS. 3 and 4 in the absence of the arc fault. Preferably, the manual operator 120 includes, for example and without limitation, a white portion (not shown) that is normally within the housing opening 123 and, thus, hidden in the closed position of FIG. 3. However, in the open position of FIG. 4, and in the absence of an arc fault, that white portion is exposed to signify either a manual opening of the circuit breaker 1 or a thermal trip.

Figure 8:
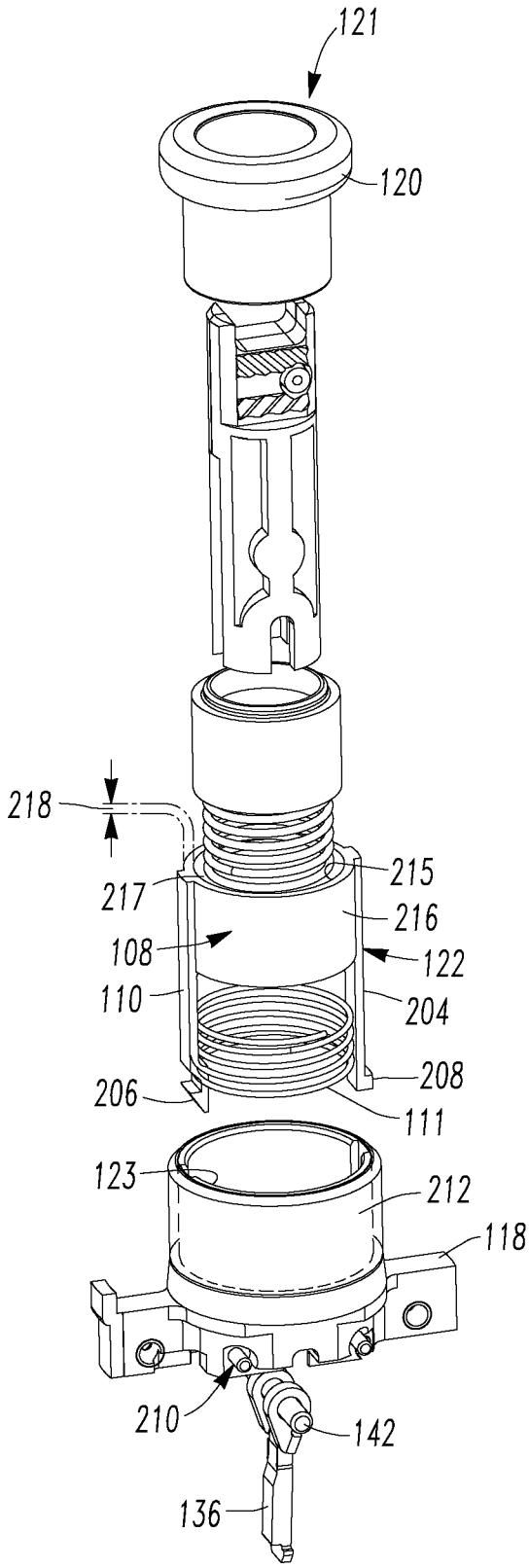
FIG. 8 is an exploded isometric view of the operating handle, indicator and bezel of FIG. 2.

As shown in FIG. 5, when the plunger 106 (FIG. 2) and the ambient temperature compensation bimetal 190 (FIG. 2) cooperate to release the clevis 136 and, thus, the plunger assembly 121, the ambient temperature compensation bimetal 190 and the latch member 191 (FIG. 2) thereof move left (with respect to FIGS. 2-5) (as best shown in FIG. 8) to release the indicator leg 110 to the position shown in FIG. 5 responsive to detection of an arc fault. This extends the manual operator 120 further external to the housing 112 responsive to detection of an arc fault and, also, extends the indicator portion 108, which indicates that the trip was responsive to detection of an arc fault.

As shown in FIGS. 3-5 and 8, the trip indicator 122 also includes a second leg 204 disposed from the indicator portion 108. The first leg 110 includes a hook-shaped portion 206, which engages the latch member 191 (FIG. 2) of the ambient temperature compensation bimetal 190, and which is released in response to detection of an arc fault. The second leg 204 includes a foot 208, which advantageously acts as a stop, as is best shown in FIG. 5, for stopping the upward vertical (with respect to FIGS. 3-5) travel of the trip indicator 122 after it is released. The foot 208 engages the interior surface 125 of the ferrule 118 after the latch member 191 (FIG. 2) releases the first leg 110 responsive to detection of an arc fault, thereby limiting travel of the indicator portion 108 external to the housing 112. This determines how much of the indicator portion 108 (e.g., without limitation, a yellow band) is exposed above the top (with respect to FIG. 5) of the ferrule 118. The second leg 204, thus, also functions as a bearing surface and weight balance, in order to prevent the trip indicator 122 from traveling up higher (with respect to FIG. 5) on one side than the other side.

Figure 6:
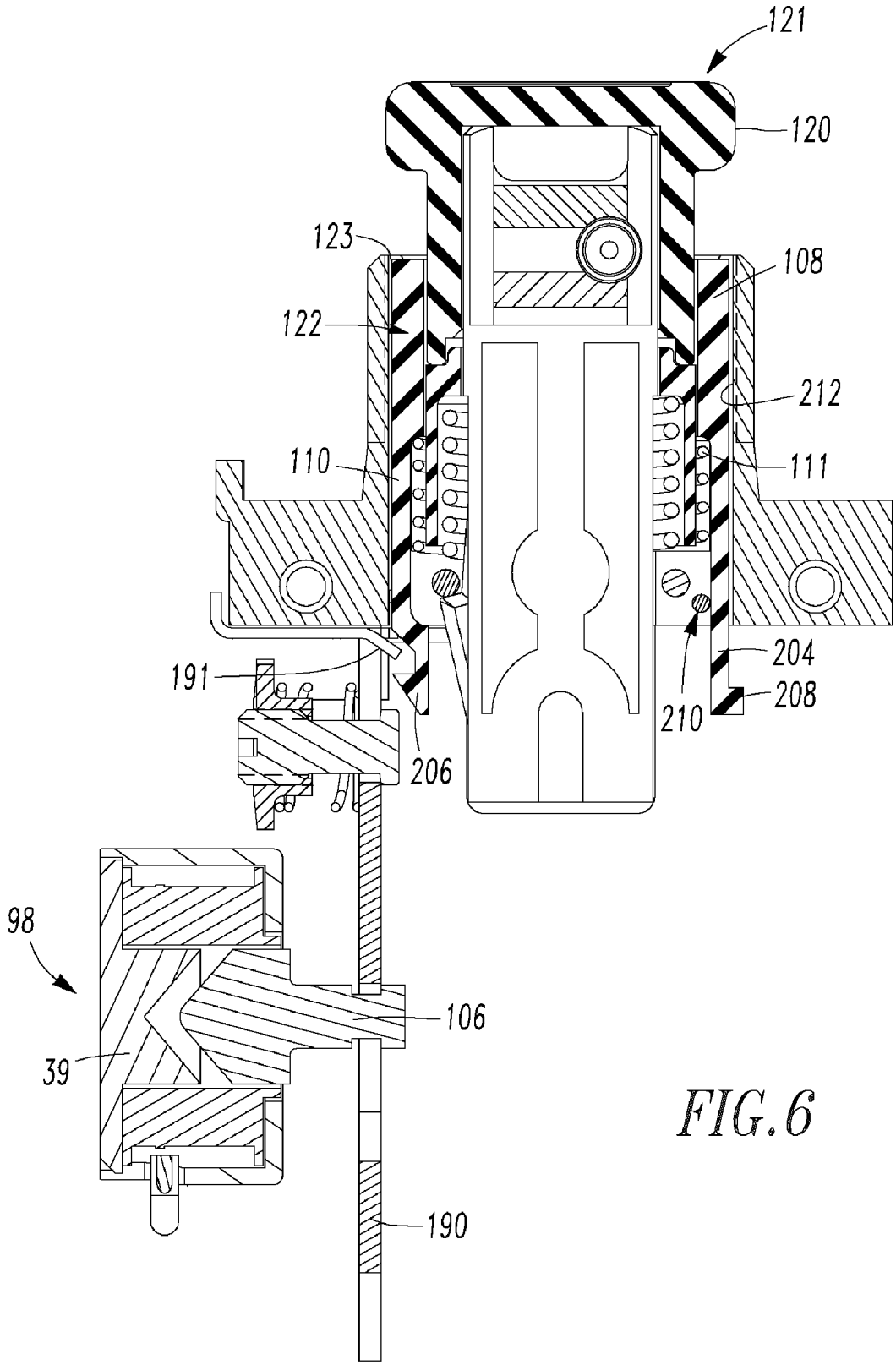
FIG. 6 is a simplified view of the operating handle, indicator and latching mechanism of FIG. 2 in the closed position.
Figure 7:
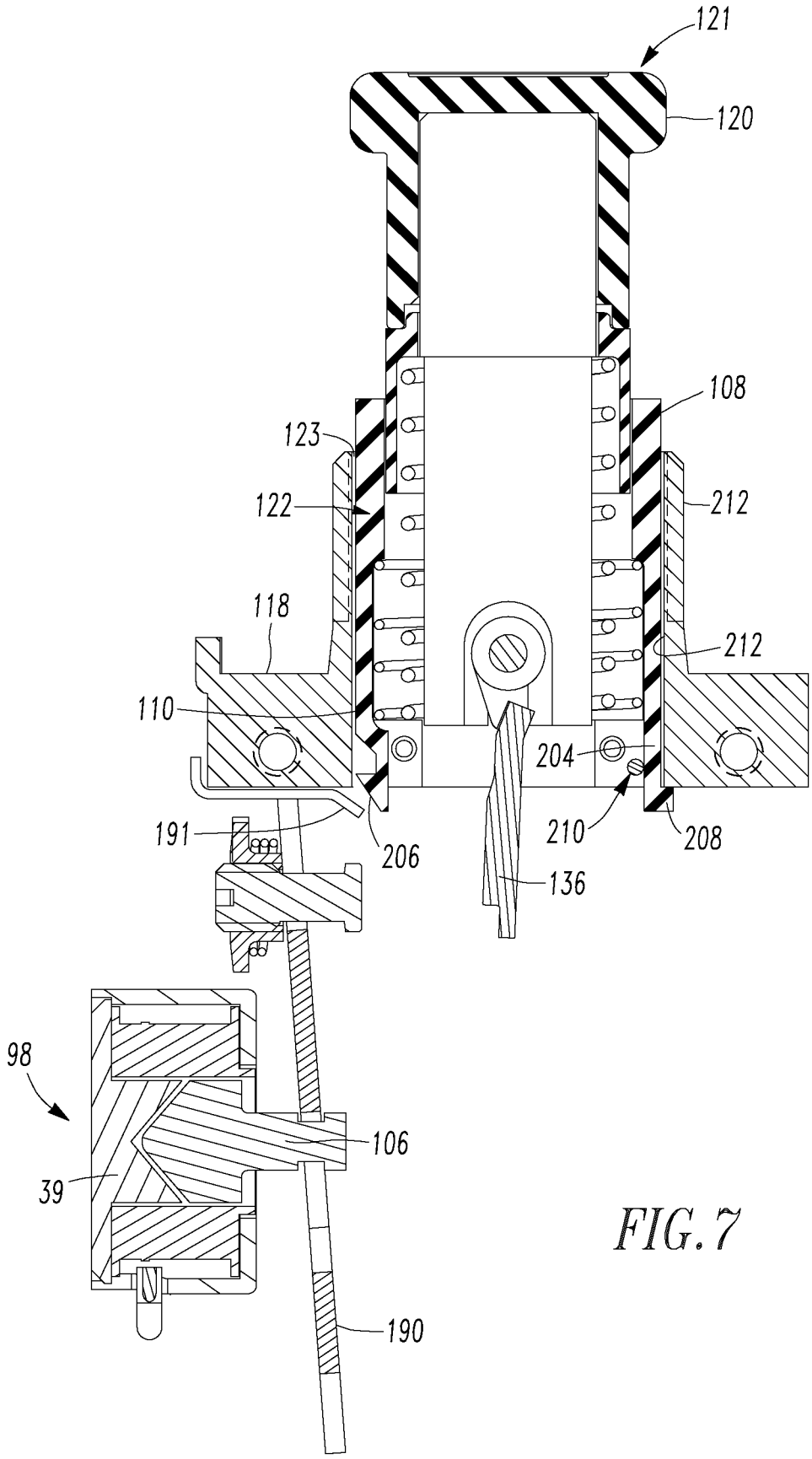
FIG. 7 is a simplified view of the operating handle, indicator and latching mechanism of FIG. 2 in the open arc fault position.

The trip indicator 122 does not deploy thermally or with movement of the ambient temperature compensation bimetal 190 (FIG. 2) in response to ambient temperature changes because the ambient temperature compensation bimetal 190 is normally fixed on both ends (as shown in FIGS. 2 and 6), although the top (with respect to FIG. 7) of the ambient temperature compensation bimetal 190 can be moved to the left (with respect to FIGS. 2 and 7) as best shown in FIG. 7. Both of the ambient temperature compensation bimetal 190 and the bimetal 184 (FIG. 2) deflect in the intermediate portions thereof with changes in ambient temperature. However, the trip indicator 122 has no impact on the thermal function of the ambient temperature compensation bimetal 190 because the springs 200 (FIG. 9) normally hold the top (with respect to FIGS. 2 and 9) of the ambient temperature compensation bimetal 190 in place. This is true until the trip coil 39 is energized and the plunger 106 is moved left (with respect to FIGS. 2 and 7), which does move the top (with respect to FIG. 7) of the ambient temperature compensation bimetal 190 left (with respect to FIG. 7), in order to cause the latch member 191 to release the trip indicator leg 110. This also moves the intermediate portion of the ambient temperature compensation bimetal 190 to the left (with respect to FIG. 7) in order to release the clevis 136 and trip open the separable contacts 100 (FIG. 10).

FIG. 6 shows a simplified view of the manual operator 120, trip indicator 122 and the latch member 191 in the closed position. The first leg 110 of the trip indicator 122 is preferably flexible and includes the hook portion 206. The latch member 191 engages the hook portion 206 and deflects the trip indicator leg 110, thereby holding the trip indicator 122 against the bias of the spring 111.

As shown in FIG. 6, the ferrule 118 of the housing 112 includes a retaining member (e.g., without limitation, pin 210) and the ferrule 118 includes a conduit 212 forming the opening 123. The plunger assembly 121 passes through the opening 123 and the manual operator 120 is disposed on the plunger assembly 121 external to the housing 112. The indicator portion 108 is a conduit surrounding the plunger assembly 121, with the second leg 204 being disposed between the retaining member (e.g., without limitation, pin 210) and the ferrule conduit 212. The example pin 210 helps to keep the arc fault trip indicator 122 positioned correctly when deployed, as shown in FIGS. 5 and 7.

FIG. 8 shows an exploded isometric view of the manual operator 120, trip indicator 122 and ferrule 118 of FIG. 2. The trip indicator 122 is preferably made of a suitable liquid crystal polymer (LCP), which provides suitable flexibility while also being suitably durable. When re-latching the trip indicator 122 (FIGS. 2-4 and 6), the force on the latch member 191 from the springs 200 (FIG. 9) sufficiently and slightly deflects the first indicator leg 110 for latching. This flexibility aids in pre-loading the latch member 191 onto the indicator leg 110 without breakage. This provides a reliable latch engagement throughout usage that withstands vibration and shock conditions of the circuit breaker 1. Furthermore, the arc fault trip indicator 122 functions independently from the thermal mechanism and, thus, has no negative impact on the circuit breaker's overcurrent protection or reliability.

The indicator portion 108, as best shown in FIG. 8, is a halo shaped conduit having an internal portion 215, an external portion 216, an opening 217 therethrough and a thickness 218 between the internal portion 215 and the external portion 217. The halo shaped conduit is disposed within the opening 123 of the ferrule 118 of the housing 112. The example thickness 218 is about 0.015 inch to about 0.020 inch. This advantageously permits the ferrule 118 to have an outside diameter of about 0.4375 inch. In contrast, U.S. Pat. No. 6,710,688 discloses a significantly larger device, a different arc fault indicator mechanism, and a 0.468 inch diameter bezel that does not fit in certain fighter and military helicopter applications.

Referring to FIG. 9, the manual operator 120, trip indicator 122 and adjustment mechanism 222 for the latch member 191 of FIG. 2 are shown. The latch member 191 normally latches the trip indicator leg 110 with a suitable force. The ambient temperature compensation bimetal 190 further includes a number of adjustment members (e.g., without limitation, set screws 224), which cooperate with the number of springs 200 to adjust this force. An increase of this force results in a relatively slower release of the trip indicator 122 responsive to detection of an arc fault; and a decrease of this force results in a relatively faster release of the trip indicator 122 responsive to detection of an arc fault and less force of the solenoid plunger 106 (FIG. 2) to cause that release. In this example, there are two set screws 224 and two springs 200. The set screws 224 provide the desired amount of spring compression to the arc fault latch member 191. This tailors the responsiveness of the latch formed by the latch member 191 and the trip indicator leg 110.

FIG. 10 shows the current path through the circuit breaker 1 of FIG. 2. When the separable contacts 100 (contacts 170, 172) are closed, the current path is established through the line terminal 114 and a first fixed contact 172A, the first movable contact 170 to the contact bridge 168 to the second movable contact 170 (not shown), the second movable contact 170 to a second fixed contact 172B, the second fixed contact 172B to a first leg (not shown) of the bimetal 184 by a first flexible conductor 219, through the bimetal 184 to a second leg (not shown) thereof to a second flexible conductor 220, and to the load terminal 116.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing including an opening;

separable contacts disposed in said housing;

an operating mechanism structured to open and close said separable contacts;

a trip mechanism structured to cooperate with said operating mechanism to trip open said operating mechanism, said trip mechanism comprising a first portion structured to trip open said operating mechanism responsive to a thermal fault, a second portion structured to compensate said first portion, and a third portion structured to trip open said operating mechanism responsive to an arc fault;

an indicator comprising an indicator portion and a leg disposed from said indicator portion; and a bias mechanism structured to bias said indicator, wherein the second portion of said trip mechanism is normally structured to hold the leg of said indicator, thereby holding said indicator against the bias of said bias mechanism, and wherein the second portion of said trip mechanism is also structured to release the leg of said indicator responsive the third portion of said trip mechanism and said arc fault, thereby releasing said indicator to the bias of said bias mechanism.

2. The circuit breaker of claim 1 wherein the first portion of said trip mechanism comprises a bimetal structured to trip open said operating mechanism responsive to the thermal fault; and wherein the third portion of said operating mechanism comprises a solenoid structured to trip open said operating mechanism responsive to the arc fault.

3. The circuit breaker of claim 1 wherein the leg of said indicator is a first leg; wherein said indicator comprises a second leg disposed from said indicator portion; wherein said housing comprises a bezel including said opening and an interior surface; wherein the first leg of said indicator includes a hook which is normally held by the second portion of said trip mechanism; wherein said bias mechanism biases said indicator portion external to said housing; and wherein the second leg of said indicator includes a foot, said foot being structured to engage the interior surface of said bezel after the second portion of said trip mechanism releases the first leg of said indicator responsive to said arc fault, thereby limiting travel of said indicator portion external to said housing.

4. The circuit breaker of claim 1 wherein the first portion of said trip mechanism comprises a first bimetal structured to trip open said operating mechanism responsive to the thermal fault; wherein the second portion of said trip mechanism comprises a second ambient compensation bimetal structured to compensate said first bimetal for changes in ambient temperature; and wherein both of said first bimetal and said second ambient compensation bimetal are elongated and comprise a first end, a second end opposite said first end and an intermediate portion between said first and second ends, said intermediate portion of said first bimetal being structured to move in a first direction responsive to an increase in current flowing through said separable contacts, said intermediate portion of said first bimetal being structured to move in an opposite second direction responsive to a decrease in current flowing through said separable contacts, said intermediate portion of said second ambient compensation bimetal being structured to move in the first direction responsive to an increase in said ambient temperature, said intermediate portion of said second ambient compensation bimetal being structured to move in the opposite second direction responsive to a decrease in said ambient temperature.

5. The circuit breaker of claim 4 wherein the third portion of said trip mechanism comprises an arc fault trip circuit and a solenoid including a coil and a plunger; wherein said second ambient compensation bimetal comprises a spring normally holding the first end of said second ambient compensation bimetal fixed with respect to said housing, the first end of said second ambient compensation bimetal carrying a latch member, said latch member normally latching the leg of said indicator; wherein said arc fault trip circuit is structured to detect said arc fault and energize said coil; and wherein said plunger, responsive to said coil being energized, is structured to move the intermediate portion of said second ambient compensation bimetal in the opposite second direction in order to trip open said separable contacts, and also move the first end of said second ambient compensation bimetal, in order that said latch member releases the leg of said indicator responsive to said arc fault.

6. The circuit breaker of claim 1 wherein said operating mechanism comprises a stem passing through the opening of said housing and an operating member disposed on said stem external to said housing; wherein said indicator portion is a conduit surrounding said stem; wherein the first portion of said trip mechanism comprises a first bimetal structured to trip open said operating mechanism responsive to the thermal fault; wherein the second portion of said trip mechanism comprises a second ambient compensation bimetal structured to compensate said first bimetal for changes in ambient temperature, said second ambient compensation bimetal comprising a spring and an end holding a latch member, said spring normally holding the end of said second ambient compensation bimetal fixed with respect to said housing, said latch member normally latching the leg of said indicator, the second ambient compensation bimetal and said third portion of said trip mechanism being responsive to said arc fault independent from said first bimetal.

7. The circuit breaker of claim 1 wherein said indicator is made of a liquid crystal polymer.

8. The circuit breaker of claim 1 wherein said indicator portion is a halo shaped conduit having an internal portion, an external portion, an opening therethrough and a thickness between said internal portion and said external portion, said halo shaped conduit being disposed within the opening of said housing, said thickness being about 0.015 to about 0.020 inch.

9. The circuit breaker of claim 1 wherein the leg of said indicator is flexible and includes a hook portion; and wherein the second portion of said trip mechanism engages said hook portion and deflects the leg of said indicator, thereby holding said indicator against the bias of said bias mechanism.

10. The circuit breaker of claim 1 wherein said operating mechanism comprises an operating stem passing through the opening of said housing and an operating handle disposed on said operating stem external to said housing; wherein said indicator portion is a conduit surrounding said operating stem; wherein the first portion of said trip mechanism is structured to release said operating stem and extend said operating handle further external to said housing responsive to said thermal fault; and wherein the second portion of said trip mechanism is structured to hold the leg of said indicator in the absence of said arc fault.

11. The circuit breaker of claim 1 wherein said operating mechanism comprises an operating stem passing through the opening of said housing and an operating handle disposed on said operating stem external to said housing; wherein said indicator portion is a conduit surrounding said operating stem; and wherein the second portion of said trip mechanism cooperates with the third portion of said trip mechanism to release said operating stem and extend said operating handle further external to said housing responsive to said arc fault.

12. The circuit breaker of claim 1 wherein said housing comprises a bezel including said opening; and wherein said bezel has an outside diameter of about 0.4375 inch.

13. The circuit breaker of claim 1 wherein said operating mechanism comprises an operating handle, a clevis disposed from said operating handle, a first slide portion structured to capture said clevis absent said thermal fault, and a second slide portion structured to capture said clevis absent said arc fault; wherein the first portion of said trip mechanism comprises a bimetal structured to move said first slide portion and release said clevis responsive to said thermal fault; and wherein the third portion of said trip mechanism comprises a solenoid structured to move the second portion of said trip mechanism and said second slide portion and to release said clevis responsive to said arc fault.

14. The circuit breaker of claim 1 wherein the leg of said indicator is a first leg; wherein said indicator comprises a second leg disposed from said indicator portion; wherein said housing comprises a retaining member and a bezel including a conduit forming said opening; wherein said operating mechanism comprises an operating stem passing through the opening of said housing and an operating handle disposed on said operating stem external to said housing; and wherein said indicator portion is a conduit surrounding said operating stem, said second leg being disposed between said retaining member and the conduit of said bezel.

15. The circuit breaker of claim 1 wherein the first portion of said trip mechanism comprises a first bimetal structured to trip open said operating mechanism responsive to the thermal fault; wherein the second portion of said trip mechanism comprises a second ambient compensation bimetal structured to compensate said first bimetal for changes in ambient temperature, said second ambient compensation bimetal comprising a number of springs and an end holding a latch member, said number of springs normally holding the end of said second ambient compensation bimetal fixed with respect to said housing, said latch member normally latching the leg of said indicator, the second ambient compensation bimetal and said third portion of said trip mechanism being responsive to said arc fault independent from said first bimetal.

16. The circuit breaker of claim 15 wherein said latch member normally latches the leg of said indicator with a force; and wherein said second ambient compensation bimetal further comprises a number of adjustment members, which cooperate with said number of springs to adjust said force.

17. The circuit breaker of claim 16 wherein an increase of said force results in a relatively slower release of said indicator responsive to said arc fault; and wherein a decrease of said force results in a relatively faster release of said indicator responsive to said arc fault.

18. The circuit breaker of claim 1 wherein the leg of said indicator is a first leg; and wherein said indicator comprises a second leg disposed from said indicator portion, said indicator portion being disposable through the opening of said housing, said second leg being structured to limit travel of said indicator portion through the opening of said housing.

19. An aircraft circuit breaker comprising:

a housing including an opening;

separable contacts disposed in said housing;

an operating mechanism structured to open and close said separable contacts;

a trip mechanism structured to cooperate with said operating mechanism to trip open said operating mechanism, said trip mechanism comprising a first bimetal structured to trip open said operating mechanism responsive to a thermal fault, a second ambient compensation bimetal structured to compensate said first bimetal, and an arc fault trip circuit structured to trip open said operating mechanism responsive to an arc fault;

an indicator comprising an indicator portion and a leg disposed from said indicator portion; and a bias mechanism structured to bias said indicator, wherein the second ambient compensation bimetal is normally structured to hold the leg of said indicator, thereby holding said indicator against the bias of said bias mechanism, and wherein the second ambient compensation bimetal is also structured to release the leg of said indicator responsive to said arc fault trip circuit and said arc fault, thereby releasing said indicator to the bias of said bias mechanism.

20. The aircraft circuit breaker of claim 19 wherein said arc fault trip circuit comprises an electromechanical mechanism; wherein said first bimetal moves responsive to said thermal fault to trip open said operating mechanism independent from said electromechanical mechanism; and wherein said electromechanical mechanism is structured to move said second ambient compensation bimetal responsive to said arc fault to trip open said operating mechanism.

21. The aircraft circuit breaker of claim 20 wherein said arc fault trip circuit further comprises an arc fault detection circuit; and wherein said electromechanical mechanism comprises a solenoid including a coil and a plunger, said arc fault detection circuit energizing said coil responsive to said arc fault, said plunger moving said second ambient compensation bimetal responsive to said coil being energized.

22. The aircraft circuit breaker of claim 21 wherein said second ambient compensation bimetal moves independently from said first bimetal; wherein said first bimetal moves responsive to said thermal fault and independent from the plunger of said solenoid; and wherein said plunger moves said second ambient compensation bimetal responsive to said arc fault and independent from said first bimetal.

23. The aircraft circuit breaker of claim 19 wherein said aircraft circuit breaker is a subminiature aircraft circuit breaker.

* * * * *